US006033195A

United States Patent [19]

Uppal

[11] Patent Number: 6,033,195

[45] Date of Patent: Mar. 7, 2000

[54] GEROTOR MOTOR AND IMPROVED SPOOL VALVE THEREFOR

[75] Inventor: Sohal L. Uppal, Bloomington, Minn.

[73] Assignee: Eaton Corporation, Cleveland, Ohio

[21] Appl. No.: 09/012,511

[22] Filed: Jan. 23, 1998

[51] Int. Cl.[7] ..... F01C 1/02

[52] U.S. Cl. ..... 418/61.3; 418/61.3

[58] Field of Search ..... 418/61.3

[56] References Cited

U.S. PATENT DOCUMENTS

| | | | |
|---|---|---|---|
| 3,270,681 | 9/1966 | Charlson . | |
| 3,514,234 | 5/1970 | Albers et al. . | |
| 3,778,198 | 12/1973 | Giversen . | |
| 3,873,248 | 3/1975 | Johnson | 418/61.3 |
| 4,004,866 | 1/1977 | Ohrberg | 418/61.3 |
| 4,171,938 | 10/1979 | Pahl | 418/61.3 |
| 4,311,171 | 1/1982 | Roberts | 418/61.3 |
| 4,533,302 | 8/1985 | Begley . | |
| 4,558,720 | 12/1985 | Larson | 418/61.3 |
| 4,934,911 | 6/1990 | Schulz | 418/61.3 |
| 4,992,034 | 2/1991 | Uppal . | |
| 5,061,160 | 10/1991 | Kinder | 418/61.3 |
| 5,228,846 | 7/1993 | Lammers et al. . | |

FOREIGN PATENT DOCUMENTS

| | | | |
|---|---|---|---|
| 1553004 | 9/1969 | Germany | 418/61.3 |
| 1628127 | 8/1971 | Germany | 418/61.3 |
| 241442 | 12/1986 | Germany | 418/61.3 |
| 1385965 | 3/1975 | United Kingdom | 418/61.3 |

*Primary Examiner*—Thomas Denion
*Assistant Examiner*—Thai-Ba Trieu
*Attorney, Agent, or Firm*—L. J. Kasper

[57] ABSTRACT

A gerotor motor (11) of the spool valve type, in which the spool valve (45) includes a central sealing land (85), effectively separating a high pressure region (87) from a low pressure region (89), when the motor is operating in the normal low-speed, high-torque mode. This separation of high and low pressure involves having two separate commutating openings (81,83) associated with each of the passages (79) communicating with the volume chambers (25,27) of the gerotor gear set (17). The present invention also includes an improved two-speed capability in which, in the high-speed, low-torque mode of operation, high pressure fluid is recirculated to certain of the contracting volume chambers (27), thus eliminating cavitation in the high-speed, low-torque mode.

11 Claims, 4 Drawing Sheets

GEROTOR MOTOR AND IMPROVED SPOOL VALVE THEREFOR

CROSS-REFERENCE TO RELATED APPLICATIONS

This application is related to co-pending U.S. application Ser. No. 09/012,638, filed Jan. 23, 1998 in the name of Sohan L. Uppal and Scott A. Yakimow for a "GEROTOR MOTOR AND IMPROVED VALVE DRIVE AND BRAKE ASSEMBLY THEREFOR".

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure devices used as hydraulic motors, and more particularly, to such motors in which the fluid displacement mechanism is a gerotor gear set, and the motor valving is of the spool valve type.

Rotary fluid pressure devices which include a gerotor gear set as the fluid displacement mechanism are typically used as low-speed, high-torque motors. Such gerotor motors have traditionally been classified as being either of the "spool valve" type, or of the "disk valve" type. In a spool valve gerotor motor, the valving is accomplished at a cylindrical interface between a spool valve and a spool bore defined by the surrounding housing. In a disk valve type, the valving is accomplished at a flat, transverse planar interface of a disk valve and stationary valve member.

In certain applications for low speed, high torque gerotor motors, one of the performance criteria which is especially important to the vehicle manufacturer is the mechanical efficiency at start-up of the motor, under load. This is also sometimes referred to as the starting torque efficiency of the motor, or simply the "starting efficiency". As is well known to those skilled in the art, efficiency of a hydraulic motor is expressed as a percentage, and mathematically, is the mechanical horsepower output of the motor divided by the hydraulic horsepower input to the motor.

As is also well known to those skilled in the art, the starting efficiency of a spool valve gerotor motor is typically better than that of a disk valve gerotor motor, primarily because of the amount of torque required to begin rotating the disk valve, which is biased into engagement with its stationary valve member. This would suggest that spool valve gerotor motors would be preferred for such applications where starting efficiency is an important factor.

However, as is also known to those skilled in the art, the typical prior art spool valve motor involves a pair of annular grooves, generally defined on the outer surface of the spool valve, with one of the grooves being connected to the inlet (high pressure) port and the other groove being connected to the outlet (low pressure) port. Extending axially from the grooves is a plurality of axial valve passages (also referred to as "timing slots") with the high pressure and low pressure axial passages being arranged in an interdigitated pattern. These axial passages then engage in commutating communication with passages in the valve housing which communicate with the volume chambers of the gerotor gear set, also in a manner well known to those skilled in the art.

Unfortunately, the prior art, interdigitated arrangement of the valve passages results in an extremely long, generally serpentine-shaped interface between high pressure and low pressure, and because there must, by definition, be a clearance between the valve spool and the spool bore, there is ample opportunity for cross port leakage which reduces volumetric efficiency.

In many of the applications of the type noted above where starting efficiency is important, there is also a need for two-speed capability, i.e., the ability to operate in a low-speed, high-torque mode on the work site, as well as the ability to operate in a high-speed, low torque mode during transport between work sites. Although U.S. Pat. No. 3,778,198, incorporated herein by reference, illustrates a spool valve motor having two-speed capability, it is believed that prior to the present invention, there has not been a two-speed spool valve gerotor motor in commercial production.

BRIEF SUMMARY OF THE INVENTION

Accordingly, it is an object of the present invention to provide an improved gerotor motor of the spool valve type, having good starting efficiency, but wherein the typical cross port leakage is substantially reduced, thus increasing the volumetric efficiency of the motor.

It is another object of the present invention to provide an improved gerotor motor of the spool valve type in which two-speed capability may be provided in a manner which is technically and economically feasible.

The above and other objects of the invention are accomplished by the provision of a rotary fluid pressure device of the type including housing means having a fluid inlet port and a fluid outlet port and fluid energy translating displacement means associated with the housing means, and including an internally toothed member and an externally toothed member eccentrically disposed within the internally toothed member for relative oribital and rotational movement, to define expanding and contracting fluid volume chambers in response to the orbital and rotational movement. Valve means cooperates with the housing means to provide fluid communication between the inlet port and the expanding volume chambers and between the contracting volume chambers and the outlet port. A shaft means is provided for transmitting torque from whichever one of the internally toothed and externally toothed members has rotational movement. The valve means comprises a generally cylindrical spool valve rotating at the speed of the rotational movement, and disposed in a spool bore defined by the housing means, the spool valve and the housing means cooperating to define a first annular groove in fluid communication with the inlet port, and a second annular groove in fluid communication with the fluid outlet port. The housing means defines an axially-extending fluid passage communicating with each of the expanding and contracting fluid volume chambers, each of the fluid passages including a first commutating opening defined by the spool bore.

The improved rotary fluid pressure device is characterized by the first and second annular grooves being separated by an annular sealing land defined by the spool valve. The spool valve defines a first plurality of axial passages in fluid communication with the first annular groove, and a second plurality of axial passages in fluid communication with the second annular groove, the first plurality of axial passages being in commutating fluid communication with the first commutating openings. Each of the axially-extending fluid passages includes a second commutating opening defined by the spool bore, the second plurality of axial passages being in commutating fluid communication with the second commutating openings.

DETAILED DESCRIPTION OF THE PREFERRED EMBODIMENT

Figure 1:
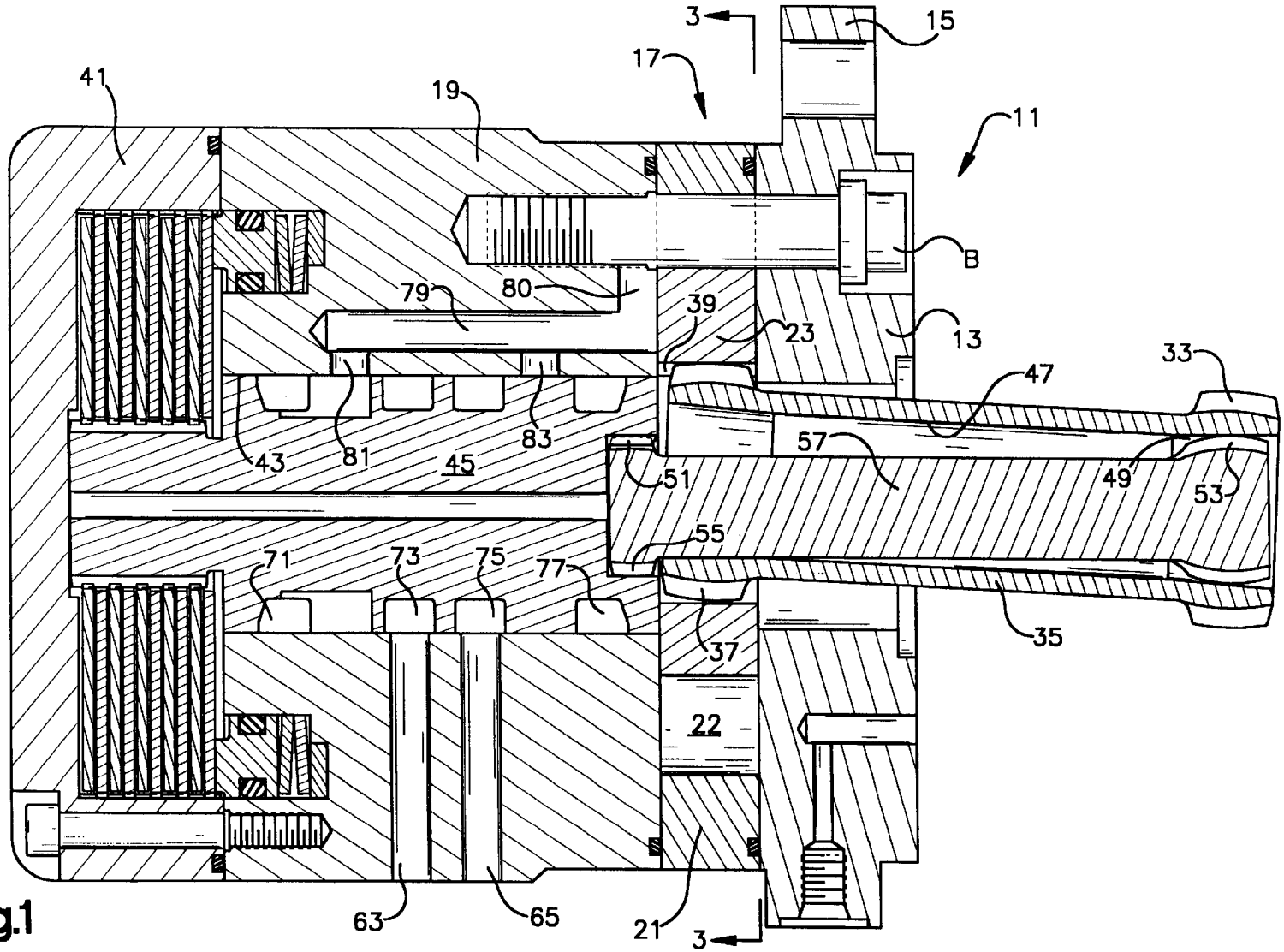
FIG. 1 is an axial cross-section of a low-speed, high-torque spool valve gerotor motor made in accordance with the present invention.
Figure 3:
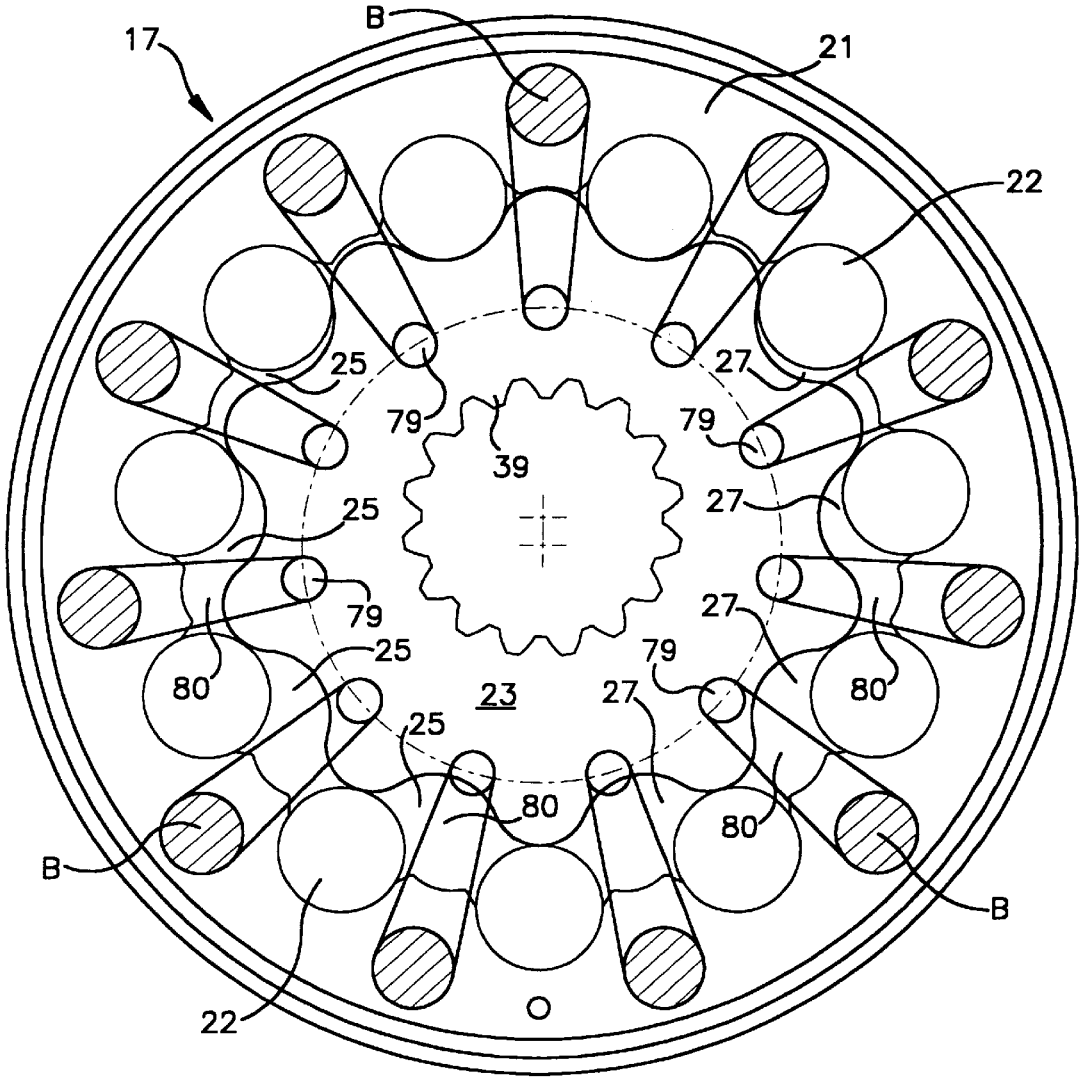
FIG. 3 is a transverse cross-section, taken on line 3—3 of FIG. 1, and including a representation of the openings in the end of the valve housing section.

Referring now to the drawings, which are not intended to limit the invention, FIG. 1 illustrates a low-speed, high-torque gerotor motor of the general type illustrated and described in U.S. Pat. No. 5,228,846, assigned to the assignee of the present invention and incorporated herein by reference. The motor, generally designated 11, comprises a plurality of sections secured together, such as by a plurality of bolts B, only one of which is shown in FIG. 1, but all of which are shown in FIG. 3. The motor 11 includes a forward end cap 13, including an enlarged flange portion 15. The motor 11 further includes a gerotor displacement mechanism, generally designated 17, and a valve housing section 19.

The gerotor displacement mechanism 17 is well known in the art, is shown and described in U.S. Pat. No. 4,533,302, assigned to the assignee of the present invention, and incorporated herein by reference, and it will be described only briefly herein. More specifically, the gerotor mechanism (gear set) 17 comprises an internally toothed ring member 21, having a plurality of internal teeth comprising rollers 22, and the gear set also includes an externally-toothed star member 23, eccentrically disposed within the ring member 21, and having one less tooth than the ring member 21. In the subject embodiment, and by way of example only, the star member 23 orbits and rotates relative to the stationary ring member 21, and this orbital and rotational movement defines a plurality of expanding fluid volume chambers 25, and a plurality of contracting fluid volume chambers 27 (see FIG. 3).

Referring again primarily to FIG. 1, the motor shown herein is of the type referred to as a "bearingless" motor, and therefore, does not include an output shaft as an integral part of the motor. Instead, the device which is to be driven by the motor 1 I will include a set of internal, straight splines, and adapted for engagement therewith is a set of external, crowned splines 33, formed on a forward end of a main drive shaft 35, the drive shaft 35 also being referred to as a "dogbone" shaft. Disposed toward a rearward end of the drive shaft 35 is another set of external, crowned splines 37, in engagement with a set of internal, straight splines 39 formed about the inside diameter of the star member 23. In the subject embodiment, and as may best be seen in FIG. 3, the ring member 21 includes eleven internal teeth, and the star member 23 includes ten external teeth. Therefore, ten orbits of the star 23 results in one complete rotation thereof, and one complete rotation of the main drive shaft 35. It should be understood by those skilled in the art that, although the present invention is illustrated and described in terms of splined connections between the star 23, the dogbone 35, and the mating device, such is not an essential feature of the invention.

The valve housing section 19 has attached thereto an end cap 41, and the housing section 19 defines a spool bore 43. Disposed within the spool bore 43 is a valve spool 45 to be described in greater detail subsequently. The drive shaft 35 defines a bore 47, at the forward end of which is a set of straight internal splines 49. Disposed toward the forward end of the valve spool 45 is another set of straight internal splines 51, and in engagement with the sets of splines 49 and 51 are sets of external, slightly crowned splines 53 and 55, respectively, the splines 53 and 55 being formed at the forward and rearward ends, respectively, of a valve drive shaft 57.

Figure 4:
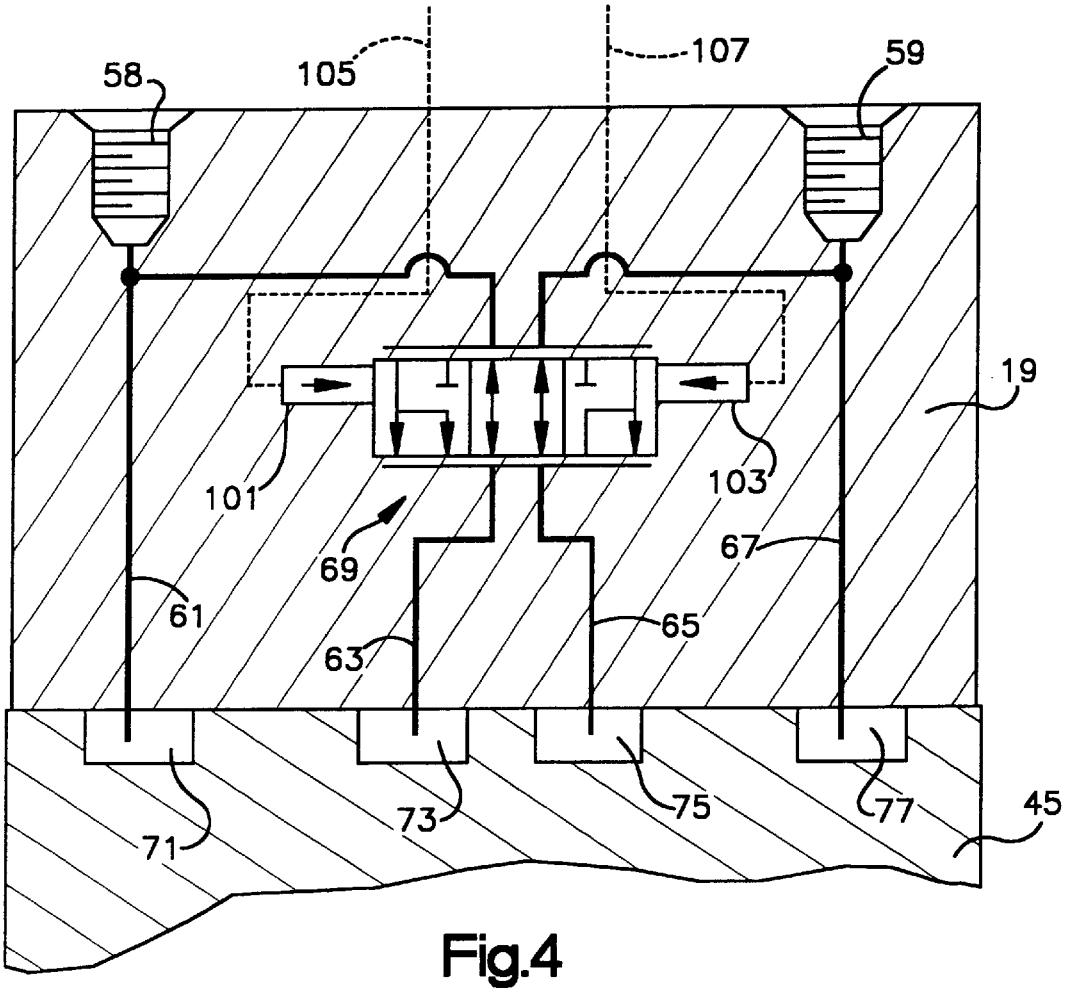
FIG. 4 is a somewhat schematic view, similar to FIG. 1, but on a larger scale, illustrating the various ports and passages, as well as the valving, involved in the two-speed capability of the present invention.

Referring now primarily to FIGS. 1 and 4, the valve housing section 19 defines a fluid inlet port 58 and a fluid outlet port 59. The housing section 19 also defines a plurality of fluid passages 61, 63, 65, and 67, which are shown only schematically (although passages 63 and 65 are also shown in FIG. 1), and each of which provides fluid communication from a control valve arrangement, generally designated 69, to the spool bore 43. For ease of illustration, the ports 58 and 59 and the control valve 69 are shown as being within the valve housing section 19, whereas, in actual production, there would typically be a separate manifold housing containing the control valve 69, with the manifold housing being bolted to the housing section 19.

The valve spool 45 defines a plurality of annular grooves 71, 73, 75, and 77, which are in continuous fluid communication with the fluid passages 61, 63, 65, and 67, respectively. Finally, the valve housing section 19 defines a plurality of axially-extending passages 79, each of which includes an enlarged opening 80 at its right end in FIG. 1 (the openings 80 being shown also in FIG. 3 for ease of illustration, and extending out toward the adjacent bolt B). Each of the enlarged openings 80 is in communication with the adjacent expanding or contracting volume chamber 25 or 27, respectively.

In accordance with one important aspect of the present invention, each of the axially-extending passages 79 includes a first commutating opening 81 and a second commutating opening 83. As may best be seen in FIGS. 1 and 2, each of the first commutating openings 81 opens into the spool bore 43 between the annular grooves 71 and 73, whereas each of the second commutating openings 83 opens into the spool bore 43 between the annular grooves 75 and 77. The reason for the provision of two commutating openings communicating with each passage 79 will be described subsequently.

Figure 2:
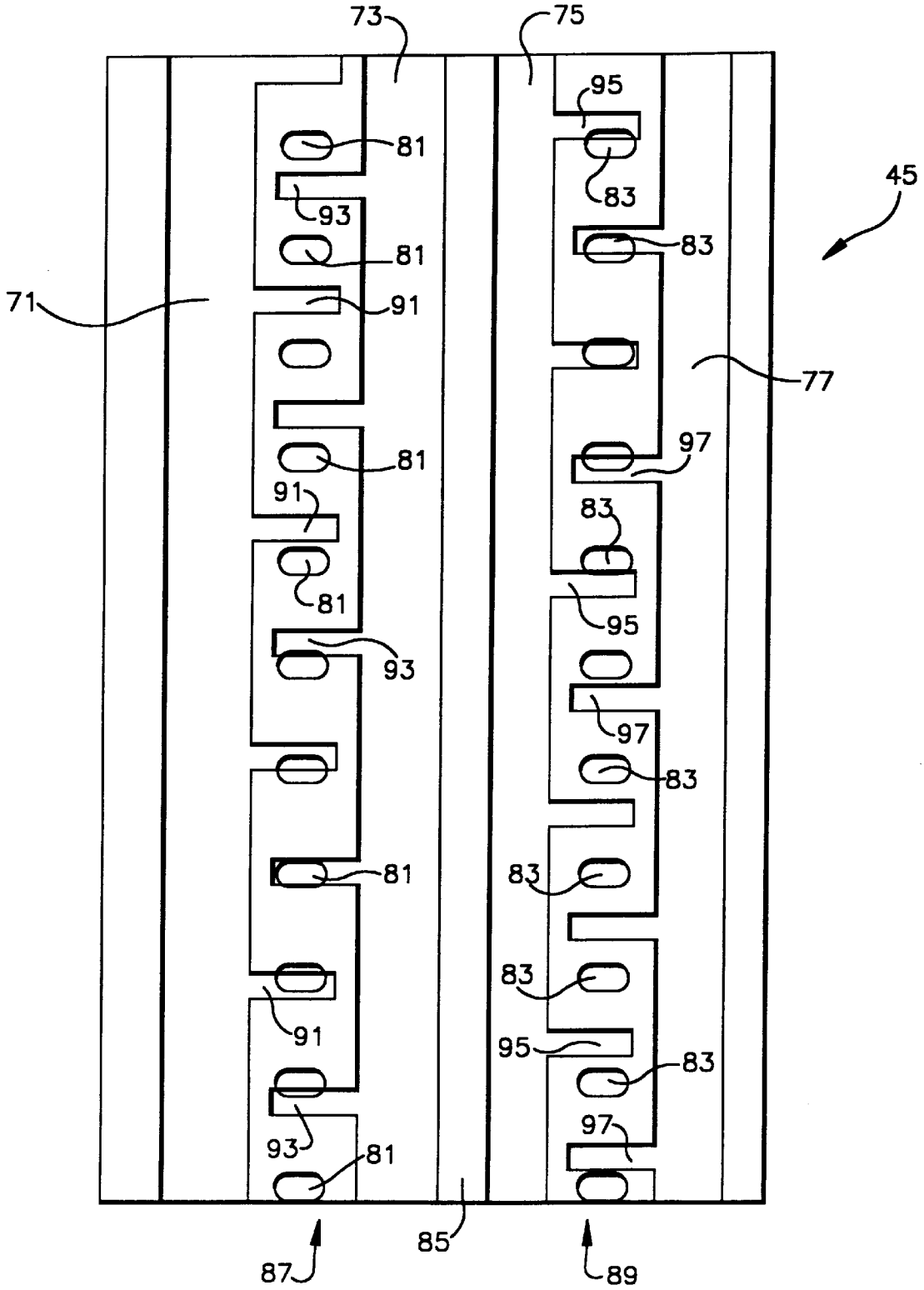
FIG. 2 is a somewhat schematic layout view of the spool valving made in accordance with the present invention, but also showing commutating openings in the valve housing.

Referring now primarily to FIG. 2, additional structural details of the valve spool 45 may be seen. In approximately the center, axially, of the valve spool 45 is a sealing land 85, which is preferably sized and finished such that it cooperates with the adjacent surface of the spool bore 43 to define substantially a journal bearing fit, i.e., a radial clearance in the range of about 0.0002 to about 0.0005 inches, for reasons which will become apparent subsequently. With the motor 11 operating in the low speed, high torque mode (corresponding to the position of the control valve 69 shown in FIG. 5), the region to the left of the sealing land 85 comprises a high-pressure region, generally designated 87, and the region to the right of the sealing land 85 comprises a low pressure region, generally designated 89.

In communication with each of the annular grooves 71, 73, 75, and 77 is a plurality of axial passages (also referred to as "timing slots") 91, 93, 95, and 97, respectively. In the subject embodiment, because there are eleven internal teeth on the ring 21, there are eleven of the passages 79 and eleven of the first commutating openings 81, and eleven of the second commutating openings 83. Furthermore, because there are ten external teeth on the star 23 there are ten of the axial passages 91 and 93 (five of each), and ten of the axial passages 95 and 97 (five of each). The reason for having two commutating openings 81 and 83 associated with each of the axially-extending passages 79 will now be described. As was noted in the BACKGROUND OF THE DISCLOSURE, in the prior art spool valve motor, the interdigitated arrangement of timing slots resulted in a very long interface between high and low pressures, and in certain applications, unacceptably high cross-port leakage. The present invention substantially overcomes the above disadvantage of the prior art spool valve motor.

In the normal high torque, low speed mode of operation, high pressure fluid fills the annular grooves 71 and 73, as well as the axial passages 91 and 93, while the annular grooves 75 and 77 and the axial passages 95 and 97 contain low pressure fluid. Therefore, referring still to FIG. 2, the axially-extending passage 79 associated with the "top" commutating openings 81 and 83 contains low pressure fluid (because the opening 83 overlaps the passage 95). As a result, the opening 81 (at low pressure) is adjacent the axial passage 93 (at high pressure) and there is a short high pressure-low pressure interface therebetween. The situation is similar for the next two opening 81 and 83, just below the top two openings in FIG. 2, but in this case there is a larger sealing land between the opening 81 and the closest adjacent passage 91 or 93. As part of the present invention, it has been determined that the arrangement illustrated in FIG. 2 results in a substantial reduction in the total (or "effective") high pressure-low pressure interface, and therefore, a substantial reduction in the cross-port leakage, at least when the motor operates in the low-speed, high-torque mode.

Referring now to FIG. 4, in conjunction with FIG. 2, the other mode of operation of the motor will be described. The control valve arrangement 69 is controlled by a pair of electromagnetic solenoids 101 and 103, which are actuated by electrical signals 105 and 107, respectively. If the vehicle operator wishes to operate the motor 11 in the high-speed, low-torque mode, the operator selects the appropriate setting of a vehicle control (not shown) and the signal 105 actuates the solenoid 101, biasing the valve 69 to the right in FIG. 4. In this position of the control valve 69, high pressure from the inlet port 58 flows through both the passages 61 and 63 (as was the case for the low-speed, high-torque mode), and also now through the passage 65. Thus, there will be high pressure in the annular grooves 71, 73, and 75, and low pressure in only the annular groove 77. The result will be that, for example, high pressure will be present in the top two commutating openings 81 and 83 (because the passage 95 now contains high pressure and is overlapped by the opening 83), but the respective axially-extending passage 79 is in communication with a contracting fluid volume chamber 27.

Viewing FIG. 3, and moving clockwise from the "transition" volume chamber at twelve o'clock, the first, third and fifth contracting volume chambers 27 receive high pressure, such that a certain amount of high pressure fluid is effectively just "recirculating", which has the same practical result as eliminating a certain number of both the expanding and contracting volume chambers. Those skilled in the art will recognize that the result would be a smaller effective displacement gerotor, such that the star member 23 would be turning faster for a given fluid flow than it would be in the low-speed, high-torque mode. In accordance with one important aspect of the present invention, it is high pressure fluid from the inlet port 58 which is being recirculated, rather than low pressure fluid, as in prior art two-speed gerotor motors. As a result, the possibility of cavitation while operating in the high-speed, low-torque mode is substantially eliminated, thus substantially improving the commercial acceptability of the two-speed motor of the present invention.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary fluid pressure device of the type including housing means having a fluid inlet port and a fluid outlet port; fluid energy translating displacement means associated with said housing means, and including an internally-toothed member, and, an externally-toothed member eccentrically disposed within said internally-toothed member for relative orbital and rotational movement, to define expanding and contracting fluid volume chambers in response to said orbital and rotational movement; valve means cooperating with said housing means to provide fluid communication between said fluid inlet port and said expanding volume chambers, and between said contracting volume chambers and said outlet port; shaft means for transmitting torque from said one of said internally-toothed and externally-toothed members having rotational movement; said valve means comprising a generally cylindrical spool valve rotating at the speed of one of said orbital and rotational movements, and disposed in a spool bore defined by said housing means, said spool valve and said housing means cooperating, to define a first annular groove in fluid communication with said fluid inlet port, and a second annular groove in fluid communication with said fluid outlet port; said housing means defining an axially-extending fluid passage communicating with each of said expanding and contracting fluid volume chambers, each of said fluid passages including a first commutating opening defined by said spool bore; characterized by:

(a) said first and second annular grooves being separated by an annular sealing land defined by said spool valve;

(b) said spool valve defining a first plurality of axial passages in fluid communication with said first annular groove, and a second plurality of axial passages in fluid communication with said second annular groove, said first plurality of axial passages being in commutating fluid communication with said first commutating openings; and (c) each of said axially-extending fluid passages including a second commutating opening defined by said spool bore, said second plurality of axial passages being in commutating fluid communication with said second commutating openings.

2. A rotary fluid pressure device as claimed in claim 1, characterized by said internally-toothed member being stationary, and said externally-toothed member having both said orbital and rotational movements.

3. A rotary fluid pressure device as claimed in claim 1, characterized by said housing means includes a valve housing member defining said fluid inlet and outlet ports, said spool bore, and said axially-extending fluid passages, said valve housing member being disposed immediately adjacent said internally-toothed and externally-toothed members, and in engagement therewith.

4. A rotary fluid pressure device as claimed in claim 1, characterized by said first and second annular grooves being defined by said spool valve, and said first and second pluralities of axial passages being defined on the outer cylindrical surface of said spool valve.

5. A rotary fluid pressure device as claimed in claim 1, characterized by said annular sealings land cooperating with said spool bore of a valve housing member to define substantially a journal bearing fit.

6. A rotary fluid pressure device as claimed in claim 1, characterized by each of said first commutating openings being substantially circumferentially aligned with said second commutating opening communicating with the same axially-extending fluid passage.

7. A rotary fluid pressure device as claimed in claim 1, characterized by said spool valve and said housing means cooperating to define a third annular groove in fluid communication with said fluid inlet port, said third annular groove being disposed on the same axial side of said annular sealing land as said first annular groove, and said spool valve and said housing means further cooperating to define a fourth annular groove in fluid communication with said fluid outlet port, said fourth annular groove being disposed on the same axial side of said annular sealing land as said second annular groove.

8. A rotary fluid pressure device as claimed in claim 7, characterized by said spool valve defining a third plurality of axial passages in fluid communication with said third annular groove, and a fourth plurality of axial passages in fluid communication with said fourth annular groove, said third plurality of axial passages being in commutating fluid communication with said first commutating openings and said fourth plurality of axial passages being in commutating fluid communication with said second commutating openings.

9. A rotary fluid pressure device as claimed in claim 8, characterized by valve means operable in one position to provide fluid communication between said fluid inlet port and said first and third annular grooves, and between said second and fourth annular grooves and said fluid outlet port for a low-speed, high-torque mode of operation.

10. A rotary fluid pressure device as claimed in claim 9, characterized by said valve means further being operable, in another position, to provide fluid communication between said fluid inlet port and said first, second and third annular grooves, and between said fourth annular groove and said fluid outlet port for a high-speed, low-torque mode of operation.

11. A rotary fluid pressure device as claimed in claim 10, wherein, in said another position of said valve means, and in said high-speed, low-torque mode of operation, relatively high pressure fluid from said fluid inlet port is being recirculated within certain of said contracting fluid volume chambers.

* * * * *